US010199732B2

(12) United States Patent
Preradovic et al.

(10) Patent No.: US 10,199,732 B2
(45) Date of Patent: Feb. 5, 2019

(54) CIRCULAR POLARIZED ANTENNAS INCLUDING STATIC ELEMENT

(71) Applicant: Nitero Pty Ltd., Fitzroy, Victoria (AU)

(72) Inventors: Stevan Preradovic, Melbourne (AU); Bo Yang, Melbourne (AU); Natalino Camilleri, Cupertino, CA (US)

(73) Assignee: ADVANCED MICRO DEVICES, INC., Sunnyvale, CA (US)

( * ) Notice: Subject to any disclaimer, the term of this patent is extended or adjusted under 35 U.S.C. 154(b) by 0 days.

(21) Appl. No.: 14/586,776

(22) Filed: Dec. 30, 2014

(65) Prior Publication Data

US 2016/0190697 A1 Jun. 30, 2016

(51) Int. Cl.

| | |
|---|---|
| ***H01Q 9/04*** | (2006.01) |
| ***H01Q 1/38*** | (2006.01) |
| *H01Q 1/22* | (2006.01) |

(52) U.S. Cl.

CPC ..... *H01Q 9/0428* (2013.01); *H01Q 1/38* (2013.01); *H01Q 1/2283* (2013.01)

(58) Field of Classification Search

CPC ..... H01Q 9/0428; H01Q 1/38
USPC ..... 343/700 MS
See application file for complete search history.

(56) References Cited

U.S. PATENT DOCUMENTS

| | | | | |
|---|---|---|---|---|
| 5,717,407 | A * | 2/1998 | Hong | H01Q 25/001 343/700 MS |
| 6,181,281 | B1 * | 1/2001 | Desclos | H01Q 1/38 343/700 MS |
| 6,549,168 | B1 * | 4/2003 | Ryken | H01Q 1/286 343/700 MS |
| 7,212,163 | B2 * | 5/2007 | Huang | H01Q 19/026 343/700 MS |
| 7,626,549 | B2 | 12/2009 | Channabasappa | |
| 2002/0163468 | A1 * | 11/2002 | Anderson | H01Q 9/0457 343/700 MS |
| 2004/0090370 | A1 * | 5/2004 | McCarrick | H01Q 9/0414 343/700 MS |
| 2004/0100405 | A1 * | 5/2004 | Mohamadi | H01Q 1/38 343/700 MS |

(Continued)

OTHER PUBLICATIONS

U.S. Appl. No. 14/586,757, filed Dec. 30, 2014, Office Action dated Jul. 5, 2016.

(Continued)

*Primary Examiner* — Dameon E Levi
*Assistant Examiner* — David Lotter
(74) *Attorney, Agent, or Firm* — Hickman Palermo Becker Bingham LLP; Edward A. Becker

(57) ABSTRACT

An apparatus comprising at least one antenna for transmission and/or reception of circularly polarized electromagnetic radiation. The antenna includes a radiating element, a static element, and a single feed line. The single feed line is coupled between the radiating element and a circuit that drives the antenna. The radiating element has a non-symmetrical outer perimeter shape. The radiating element may include an aperture. The antenna may further include a ground element and a supplemental ground feed structure, the supplemental ground feed structure located between the radiating element and the ground element and the radiating element located between the supplemental ground feed structure and the static element.

25 Claims, 10 Drawing Sheets

(56) References Cited

U.S. PATENT DOCUMENTS

| | | | | |
|---|---|---|---|---|
| 2009/0058731 | A1* | 3/2009 | Geary | H01Q 5/378 343/700 MS |
| 2009/0153404 | A1* | 6/2009 | Ryou | H01Q 9/0407 343/700 MS |
| 2010/0327068 | A1* | 12/2010 | Chen | G06K 19/07749 235/492 |
| 2013/0194147 | A1* | 8/2013 | Yoshioka | H01Q 9/0428 343/787 |
| 2013/0321214 | A1* | 12/2013 | Zhou | H01Q 9/0407 343/700 MS |
| 2015/0357718 | A1 | 12/2015 | Singh | |
| 2016/0190696 | A1 | 6/2016 | Preradovic et al. | |

OTHER PUBLICATIONS

Preradovic, U.S. Appl. No. 14/586,757, filed Dec. 30, 2014, Final Office Action dated Mar. 2, 2017.

Preradovic, U.S. Appl. No. 14/586,757, filed Dec. 30, 2014, Final Office Action, dated Jun. 6, 2018.

* cited by examiner

CIRCULAR POLARIZED ANTENNAS INCLUDING STATIC ELEMENT

FIELD OF THE INVENTION

The present invention relates to devices that operate in at least the millimeter wave (mm-wave) and/or sub-millimeter wave (sub mm-wave) frequency bands, and more specifically, to an integrated circuit package including antennas that provide circular polarization-shaped radiation pattern.

BACKGROUND

The availability of millimeter wave (mm-wave) frequency bands has contributed to the expansion of main stream applications of mm-wave wireless technologies. The 60 GHz band, for example, has various applications, such as Wireless HD and WiFi standard 802.11ad. Also, the progress in developing mm-wave radio frequency integrated circuits (RFICs) is providing the path to mobile and personal computing applications. Packaging for mm-wave RFICs include a plurality of antennas to facilitate communications between mm-wave transceivers. A plurality of antennas, also referred as to as an antenna array, is typically included to achieve a desired gain and directivity in the antenna radiation pattern. One or more of the antenna array elements is configured for circular polarization radiation pattern shape. To achieve this pattern shape, however, requires the RFIC package to include phase shifting components in the signal fed to each of the circularly polarized antenna array elements, which increases the size, complexity, and cost of the RFIC package. Achieving circular polarization across a wide frequency bandwidth is also difficult without increasing the size, complexity, and cost of the RFIC package.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

Embodiments are depicted by way of example, and not by way of limitation, in the figures of the accompanying drawings and in which like reference numerals refer to similar elements and in which.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

I. Overview

An apparatus includes one or more antennas configured to use circularly polarized electromagnetic radiation, e.g., for transmission and/or reception. The apparatus also includes one or more integrated circuits electrically coupled to the one or more antennas. Each of the antennas is electrically coupled to an integrated circuit via a respective single feed line. Each of the antennas comprises a patch antenna capable of operating across a wide frequency bandwidth at least in the millimeter wave (mm-wave) and/or sub-millimeter wave (sub mm-wave) frequency spectrum. As an example, the antennas operate in the 60 GHz band (e.g., in the range of approximately 57 to 66 GHz), although the antennas are capable of operating in other frequency bands as discussed in detail below. As another example, the antennas can operate in 24 GHz, 72 GHz, 85 GHz, 120 GHz, less than 60 GHz, more than 60 GHz, and the like. Various configurations of the antennas are contemplated, as discussed in detail below. The antennas are compact in size to minimize footprint requirements in the apparatus. In this manner, a plurality of antennas can be included in the apparatus for transmitting and receiving circularly polarized electromagnetic radiation having a desired gain and directivity profile for operation in the mm-wave carrier frequencies (or other frequencies) while also being compact and efficient to operate.

Figure 1A:
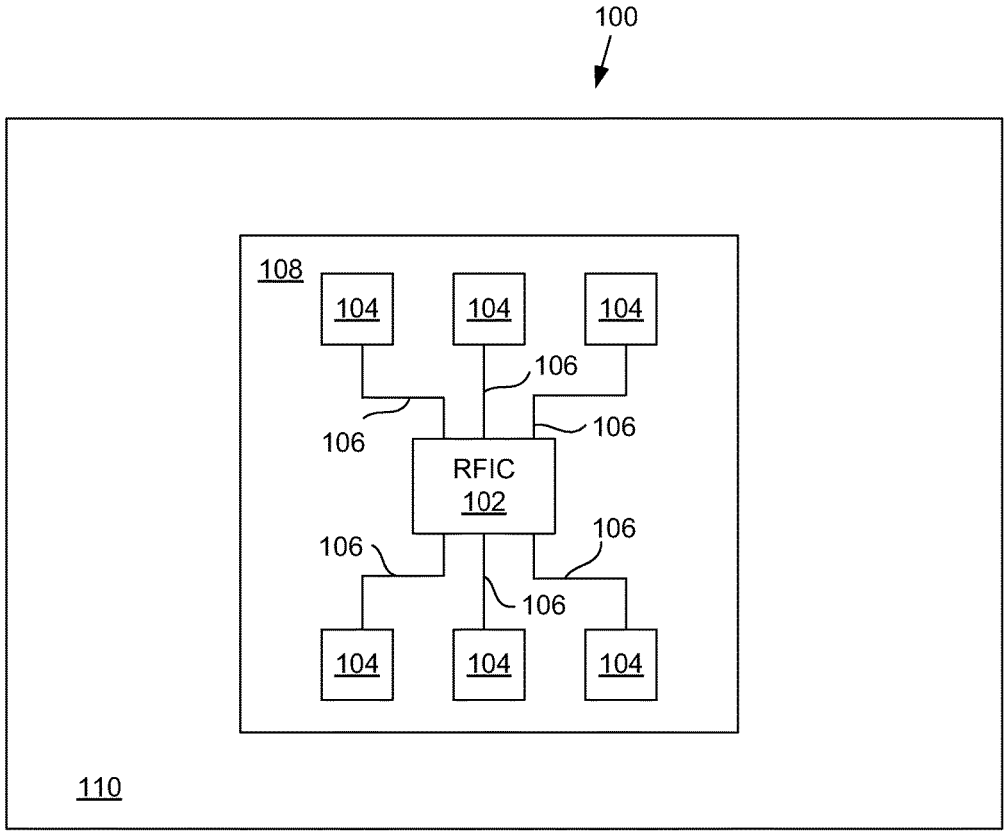
FIG. 1A illustrates a top view of an example apparatus including a plurality of antennas according to an embodiment.

FIG. 1A illustrates a top view of an example apparatus 100 including a plurality of antennas according to an embodiment. The apparatus 100 includes a radio frequency integrated circuit (RFIC) 102, a plurality of antennas 104, a plurality of feed lines 106, a package 108, and a printed circuit board (PCB) 110. Each of the plurality of antennas 104 is electrically coupled to the RFIC 102 via a respective one of the plurality of feed lines 106. Each of the plurality of feed lines 106 may comprise any number of conductive lines or traces, although in an embodiment, each of the plurality of feed lines 106 comprises a single feed line or trace. The RFIC 102 may be packaged as a chip, and accordingly may also be referred to as a chip. The RFIC 102 may include a receiver, a transmitter, a transceiver, a processor, a memory, and/or other circuitry to interface with the plurality of antennas 104.

In an embodiment, RFIC 102, antennas 104, and feed lines 106 are included in the package 108. Package 108 may comprise packaging for the RFIC 102 but which also includes sufficient area to include the antennas 104 and feed lines 106. Package 108 is mounted or soldered to PCB 110. PCB 110 is larger than the package 108, and may include other integrated circuits, chips, packages, electronics, power supply circuits, components, and the like (not shown). Although not depicted in FIG. 1A, PCB 110 comprises one or more layers (e.g., six layers, 10 layers, 24 layers, and the like), in which components may be located between such layers to form a stacked structure.

In another embodiment, package 108 is absent in apparatus 100. RFIC 102, antennas 104, and feed lines 106 are provided directly on/in the PCB 110. In this configuration, PCB 110 may be considered a package for at least the RFIC 102, antennas 104, and/or feed lines 106.

In alternative embodiments, antennas 104 and feed lines 106 can be located within RFIC 102. Apparatus 100 may also include other components and elements, depending upon a particular implementation, and apparatus 100 is not limited to any particular components or elements.

Figure 1B:
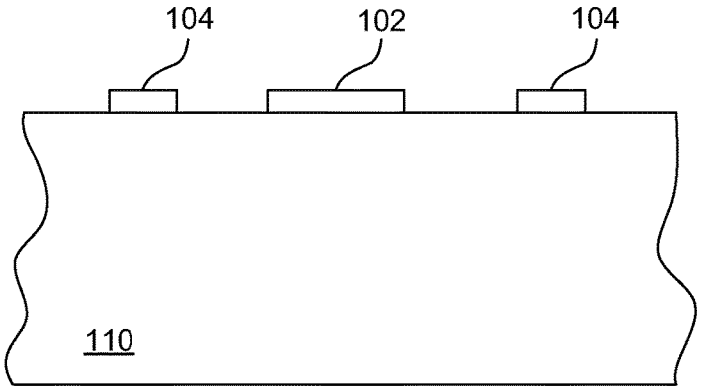
FIGS. 1B-1D illustrate example cross sectional views of a printed circuit board or packaging showing various placement of an integrated circuit and antennas relative to each other, according to some embodiments.
Figure 1C:
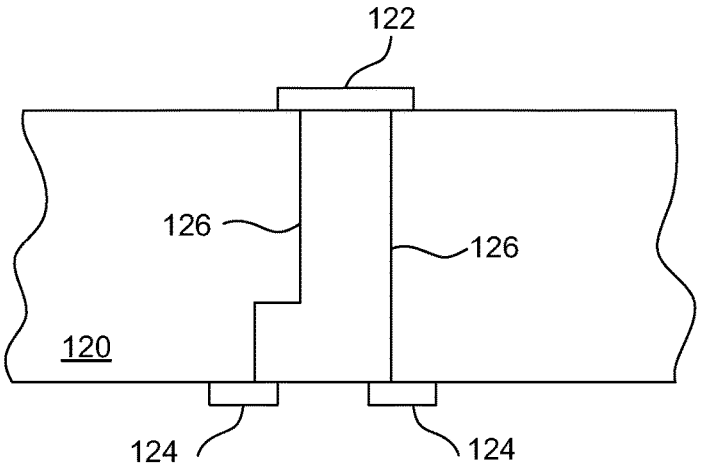
Figure 1D:
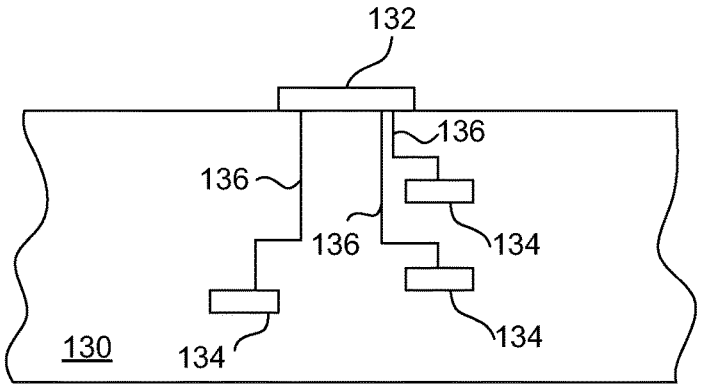

RFIC 102 and antennas 104 are located on the same or different plane/side of PCB 110 relative to each other. FIGS. 1B-1D illustrate example cross sectional views of a PCB (also referred to as a package or packaging) showing various placement of RFIC 102 and antennas 104 relative to each other, according to some embodiments. In FIG. 1B, RFIC 102 and antennas 104 are located on the same plane or side of PCB 110 (e.g., top side of PCB 110). The feed lines 106 are accordingly also co-located on the same plane or side of PCB 110.

In FIG. 1C, a RFIC 122 and antennas 124 are located on different planes/sides of a PCB 120. RFIC 122 is located on a first plane/side (e.g., the top side) and antennas 124 are located on a second plane/side (e.g., the bottom side) that is the opposing or opposite plane/side to the first plane/side. Vias 126 embedded within PCB 120 connect antennas 124 to RFIC 122. This type of configuration is referred to as flip-chip packaging. Although not shown, the locations of RFIC 122 and antennas 124 may be reversed, with RFIC 122 located on the bottom side and antennas 124 located on the top side of PCB 120. In FIG. 1D, one or more antennas 134 are embedded within layers of a PCB 130 and a RFIC 132 is located on a plane/side (e.g., top or bottom side) of PCB 130. Vias 136 located within PCB 130 connect antennas 134 to RFIC 132.

In alternative embodiments, one or more combinations of component arrangements on and/or in a PCB may be possible depending on space, fabrication, performance, and/or other constraints. For example, at least one antenna from among a plurality of antennas may be embedded on a plane/side of the PCB and at least one other antenna from among the plurality of antennas may be embedded in the PCB.

II. Antenna Structures

Figure 2A:
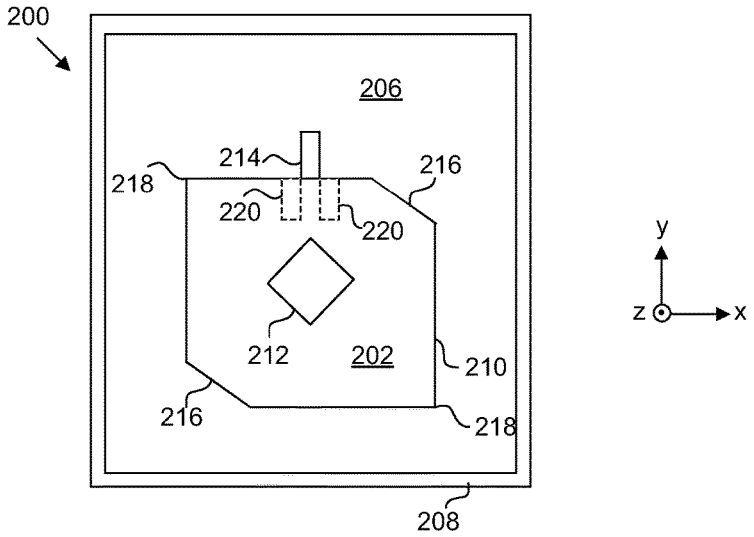
FIGS. 2A-2C illustrate an antenna according to an embodiment.
Figure 2B:
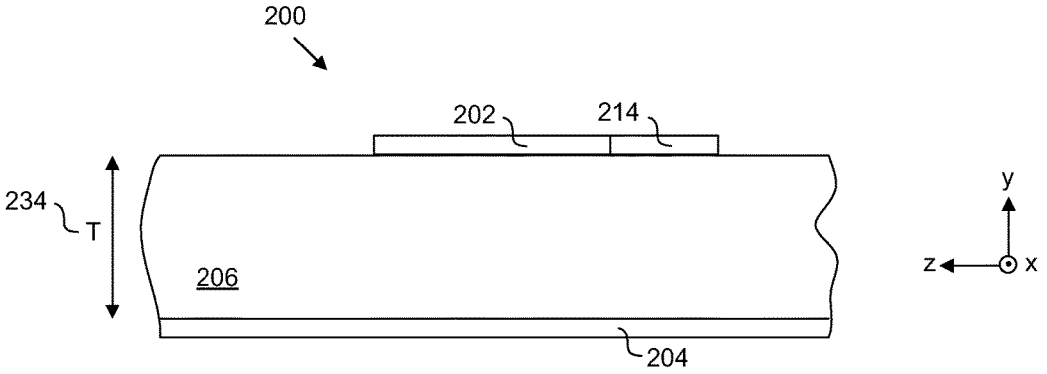

FIGS. 2A-2B illustrate a circular polarized in-package antenna 200 according to an embodiment. FIG. 2A shows a top view of the antenna 200. FIG. 2B shows a cross sectional view of the antenna 200. Antenna 200, also referred to as a patch antenna, an antenna structure, or a circular polarized antenna, comprises any of the antennas 104, 124, and/or 134 discussed above. Antenna 200 comprises a three layer structure: a radiating element 202 separated from a ground element 204 by a substrate 206. As shown in FIG. 2B, ground element 204, also referred to as a radiating element ground or a ground plane, is positioned on a first plane or side of the substrate 206. Radiating element 202 is positioned on a second plane or side of the substrate 206, the first plane/side being opposite to the second plane/side of the substrate 206. Radiating element 202 is stacked above the ground element 204 such that radiating element 202 and ground element 204 are co-linearly located with each other along the y-axis in accordance with a Cartesian coordinate system. Elements of antenna 200 may be packaged together in a package 208.

Each of the radiating element 202, ground element 204, and feed line or trace 214 comprises a conductive material such as, but not limited to, a metal, copper, gold, aluminum, and like equivalents. As used herein, the term "conductive" refers to "electrically conductive." Substrate 206 comprises a non-conductive material such as, but not limited to, plastic, fiberglass epoxy resin, TEFLON™, low temperature co-fired ceramic (LTCC), conventional PCB material, or the like. For example, in embodiments where the antenna 200 is embedded in or on a PCB, substrate 206 may be a layer or part of the PCB. In some embodiments, substrate 206 may comprise one layer or more than one layer.

Antenna 200 may be fabricated using deposition and/or etching techniques. The shape of the radiating element 202, for example, can be defined by a mask, and conductive material can be selectively deposited or etched in accordance with the mask to form the radiating element 202 layer.

Radiating element 202 has a particular shape and dimensions, as described in detail below, to enable emission of electromagnetic radiation that is circularly polarized in one of a clockwise or counter-clockwise orientation at a certain frequency band. As shown in FIG. 2A, radiating element 202 has an outer perimeter 210, an aperture 212, and a feed line or trace 214. Outer perimeter 210 is a non-symmetrically shaped perimeter, including a first pair of opposing corners 216 that is shaped or contoured differently than a second pair of opposing corners 218. In an embodiment, each corner of the first pair of opposing corners 216 is a truncated corner or edge, also referred to as a mitered corner or mitered edge. In an alternative embodiment, each corner of the first pair of opposing corner 216 is a rounded corner or edge. If the second pair of opposing corners 218 is specifically contoured rather than the first pair of opposing corners 216, the direction of circular polarization is changed from clockwise to counter-clockwise or vice versa. In FIG. 2A, outer perimeter 210 is shown, without limitation, as having a square shape (or nearly a square shape) with a pair of truncated or mitered opposing corners.

The first and second corners of the first pair of opposing corner 216 can be identical to each other (e.g., same dimensions, contours, shape, and/or angle, etc.). Alternatively, the first and second corners of the first pair of opposing corner 216 can be different from each other (e.g., different dimensions, contours, shape, and/or angle, etc.). Likewise, the first and second corners of the second pair of opposing corner 218 can be identical or different from each other in dimensions, contours, shape, angle, and/or the like. In some embodiments, the non-symmetric portion of the outer perimeter 210 may be fewer than two corners, more than two corners, adjacent corners, corners that are not on opposing or opposite to each other, and/or the like.

Aperture 212 comprises a hole or slot located at the center or approximate/substantially in the center of the radiating element 202. The shape of aperture 212 can be any shape, including, without limitation, a geometric shape, a symmetric shape, a non-symmetric shape, and the like. For example, aperture 212 can be a square, approximately a square, a rectangle, approximately a rectangle, a circle, approximately a circle, elliptical, approximately elliptical, or other shape. Although aperture 212 is depicted as being in the center or substantially in the center of radiating element 202, aperture 212 need not be centrally located. Instead, the location of aperture 212 may vary depending upon a particular implementation.

Feed line or trace 214 is used to connect antenna 200 to an RFIC, such as RFIC 102, 122, or 132. The signal input to antenna 200 is fed in using a single line or trace. A feed network, splitter, phase shifting component, or multiple feed lines is not required to generate circular polarized output. In an embodiment, antenna 200 having a non-symmetrically shaped outer perimeter, an aperture, and a single feed line, when driven by an input signal to the feed line, emits circularly polarized radiation at a certain frequency band. In another embodiment, antenna 200 having a non-symmetrically shaped outer perimeter and a single feed line, when driven by an input signal to the feed line, generates circularly polarized radiation at a certain frequency band. Although the feed line 214 is depicted as a single feed line, in alternative embodiments, feed line 214 may comprise any number of conductive lines or traces, such as two lines.

In some embodiments, radiating element 202 further includes a pair of impedance matching slots 220 adjacent to the feed line or trace 214. The pair of impedance matching slots 220 comprises an impedance matching component in the feed line to match impedance between the antenna 200 and the RFIC. Slots 220 are optional for circular polarization generation having the performance characteristics discussed herein.

Ground element 204 is depicted as extending beyond the dimensions of radiating element 202 in FIGS. 2A-2B (e.g., extending across the entire or substantially entire base of the antenna structure). In alternative embodiments, ground element 204 can have different dimensions than depicted. For example, ground element 204 may have the same or similar dimensions to that of radiating element 202. As another example, ground element 204 may have the same or similar dimensions to that of radiating element 202 is some regards but not in others. As another example, ground element 204 may have any shape, contour, dimensions, partial overlap, and/or complete overlap relative to radiating element 202 as long as the ground element 204 provides grounding functions for the antenna structure.

Figure 2C:
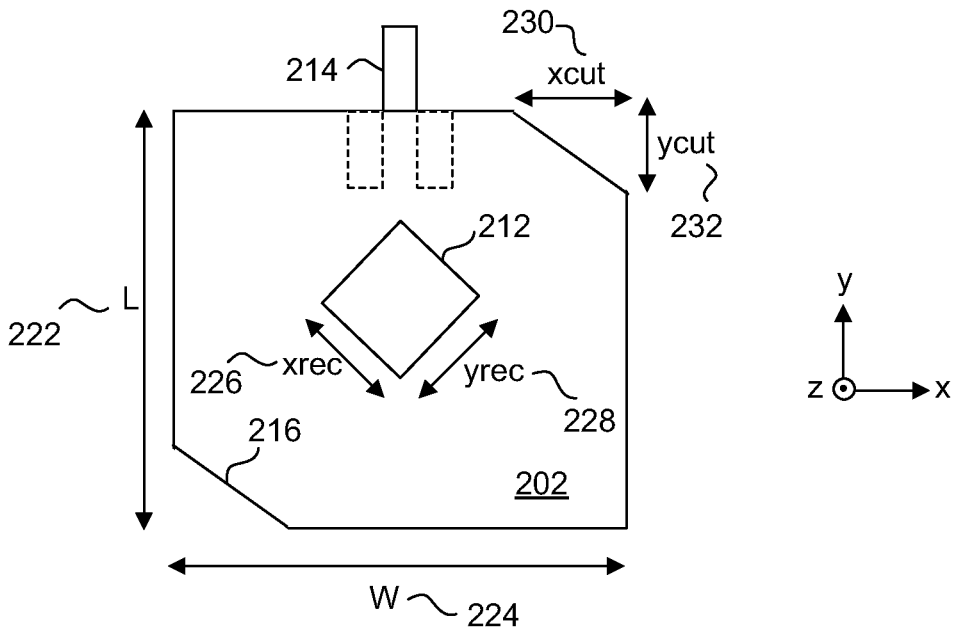

FIG. 2C denotes dimensions of interest that define the shape of antenna 200 according to an embodiment. An example shape of radiating element 202 is defined by: an antenna length 222 (denoted as L), an antenna width 224 (denoted as W), a width 226 of the aperture 212 (denoted as xrec), a length 228 of the aperture 212 (denoted as yrec), a width or first offset 230 of each corner of the first pair of opposing corners 216 (denoted as xcut), and a length or second offset 232 of each corner of the first pair of opposing corners 218 (denoted as ycut). Example values of dimensions 222-232 are provided in the table below.

| Dimensions | Values (in free space wavelength λ of the center frequency of the operating band) |
|---|---|
| L—antenna length | 2.19λ |
| W—antenna width | 2.39λ |
| xrec—width of rectangular slot | 7.51λ |
| yrec—length of rectangular slot | 5.84λ |
| xcut—width of the cut | 10.52λ |
| ycut—length of the cut | 6.58λ |

The dimension values provided in the table are applicable for antenna operation, for example without limitation, at or around a free space wavelength λ of 4.84 mm. Free space wavelength λ may also be referred to as the wavelength λ in free space, center wavelength λ, or operating wavelength λ. A free space wavelength of 4.84 mm corresponds to a frequency of 62 GHz based on the relationship $f=c/\lambda$, where c is the speed of light. The 62 GHz frequency, also referred to as the center frequency or operating frequency, is within the 57 to 66 GHz frequency band, which is the IEEE 802.11ad protocol frequency band of operation.

A thickness 234 (denoted as T) of the substrate 206 (see FIG. 2B) has a minimum value of approximately λ/20. If the thickness 234 is too thin, the operating bandwidth of antenna 200 may be too narrow. In alternative embodiments, if the substrate 206 is a different material and/or has different properties than those of a PCB-type material, the dimensional values can vary in the range of approximately +/−20% from those provided above.

Even if the shape of antenna 200 stays the same, the size of antenna 200 can be scaled up or down in accordance with the carrier frequency. Wavelength is inversely proportional to frequency. Hence, as frequency increases, wavelength decreases. Accordingly, as shown by the example dimensional values above, as frequency increases, antenna dimensions decrease. For example, if the center frequency doubles, antenna 200 would be halved in size. If the frequency doubled again, antenna 200 may be a quarter of the starting size.

Note that while radiating element 202 is square-ish in overall shape, it may actually be rectangular (e.g., length L is shorter than width W). Likewise, the truncation or mitered angle of the contoured corners need not be at 45 degrees and can instead be at any angle. The particular combination of dimensions of the antenna 200, such as the amount of mitering, size of the aperture 212, or shape of the aperture 212, are optimized to achieve the desired performance characteristics.

Figure 2D:
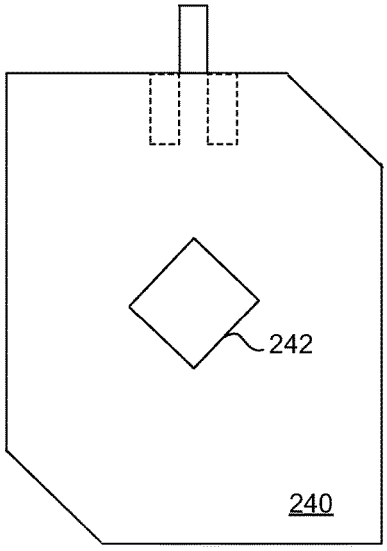
FIGS. 2D-2F illustrate a radiating element of an antenna according to alternative embodiments.
Figure 2E:
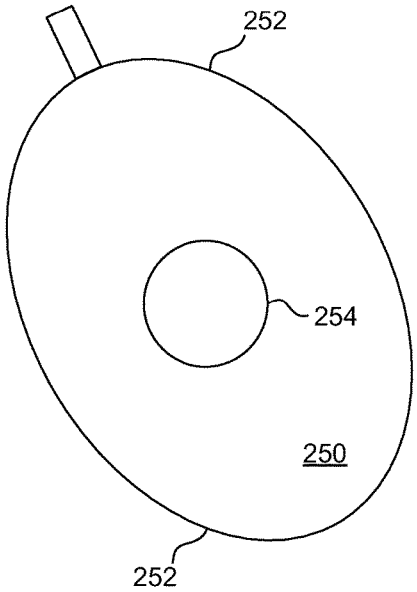
Figure 2F:
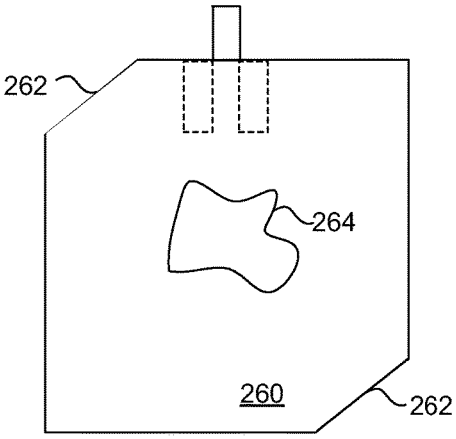

In alternative embodiments, radiating element 202 can be configured in a variety of shapes. For example, without limitation, a radiating element 240 shown in FIG. 2D has a rectangular shape with truncated/mitered corners and a square shaped aperture 242. A radiating element 250 shown in FIG. 2E has an elliptical shape and a circular aperture 254. A pair of opposing corners 252 of the outer perimeter of radiating element 250 is rounded, instead of being mitered, to the extent that the overall shape resembles an ellipse. A radiating element 260 shown in FIG. 2F has a square shape with mitered corners 262 and a non-symmetrically shaped aperture 264.

Figure 3A:
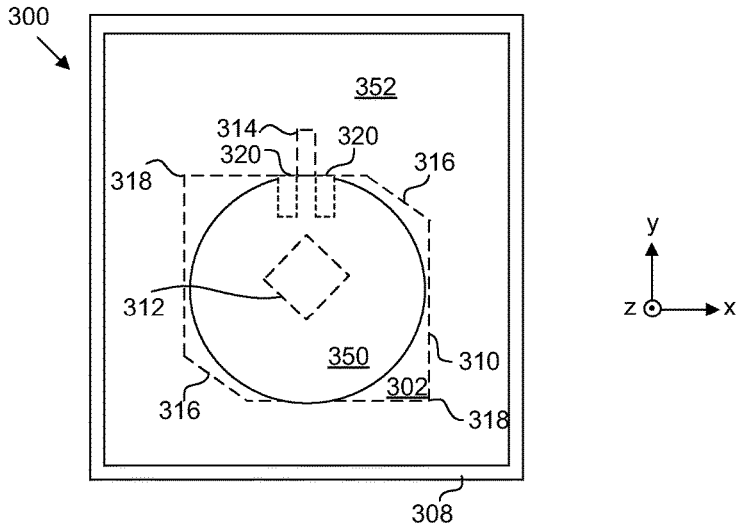
FIGS. 3A-3C illustrate an antenna including a static element according to another embodiment.
Figure 3B:
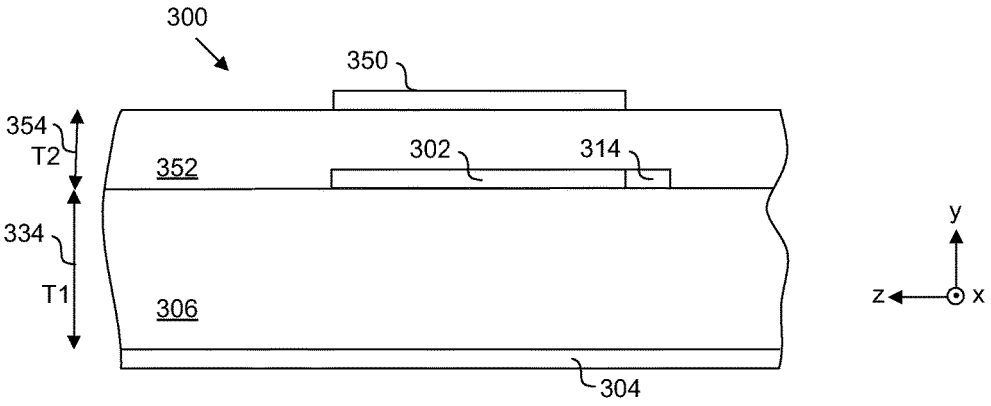

FIGS. 3A-3B illustrate a circular polarized in-package antenna 300 according to another embodiment. FIG. 3A shows a top view of the antenna 300. FIG. 3B shows a cross sectional view of the antenna 300. Antenna 300, also referred to as a patch antenna, a patch antenna with a parasitic static element, an antenna structure, or a circular polarized antenna, comprises any of the antennas 104, 124, and/or 134 discussed above. Antenna 300 is similar to antenna 200 with the addition of a static element 350 (also referred to as a non-radiating static element, a stacked parasitic element, or a parasitic element) stacked above the radiating element. Inclusion of the static element 350 increases the operating bandwidth relative to the bandwidth profile associated with antenna 200, as described in detail below.

Antenna 300 comprises a first substrate 306 positioned above a ground element 304, a radiating element 302 positioned above the first substrate 306, a second substrate 352 positioned above the radiating element 302, and the static element 350 positioned above the second substrate 352. Antenna 300 comprises three conductive layers—ground element 304, radiating element 302, and static element 350—separated from each other by a respective non-conductive layer—first and second substrates 306, 352. Static element 350 is adjacent a first plane/side of radiating element 302 while the ground element 304 is adjacent a second plane/side (e.g., the opposite plane/side) of radiating element 302. In an embodiment, the ground element 304, radiating element 302, and static element 350 are co-linearly located with each other along the y-axis in accordance with a Cartesian coordinate system. Elements of antenna 300 may be packaged together in a package 308.

Radiating element 302 and ground element 304 are similar or identical to radiating element 202 and ground element 204, respectively, of antenna 200 discussed above. Likewise, the features of radiating element 302—an outer perimeter 310, an aperture 312, a feed line or trace 314, a first pair of opposing corners 316, a second pair of opposing corners 318, and a pair of impedance matching slots 320—are similar or identical to respective features of radiating element 202.

Each of the radiating element 302, ground element 304, static element 350, and feed line or trace 314 comprises a conductive material such as, but not limited to, a metal, copper, gold, aluminum, and like equivalents. Each of the first and second substrates 306, 352 comprises a non-conductive material such as, but not limited to, plastic, fiberglass epoxy resin, TEFLON™, low temperature co-fired ceramic (LTCC), conventional PCB material, or the like. For example, in embodiments where the antenna 300 is embedded in or on a PCB, first substrate 306 and/or second substrate 352 may be a layer or part of the PCB. In some embodiments, each of the first substrate 306 and/or second substrate 352 may comprise one or more layers.

Antenna 300 may be fabricated using deposition and/or etching techniques. The shape of each of the radiating element 302 and static element 350, for example, can be defined by a mask, and conductive material can be selectively deposited or etched in accordance with the mask to form the radiating element 302 layer and static element 350 layer.

While radiating element 302 is configured to emit electromagnetic radiation that is circularly polarized in a clockwise or counter-clockwise orientation at a certain frequency band, static element 350 is not a radiating patch element. Static element 350 aids in improving bandwidth of the radiation emitted by the radiating element 302. Static element 350 can also contribute to creating circular polarization. In an embodiment, static element 350 has a circular shape, is centered over the radiating element 302, and is sized to substantially "overlap" with the radiating element 302. The radiating element 302 may be smaller than the static element 350 in some respects but not in others. For example, the mitered corners of the radiating element 302 may be "covered" by the static element 350, but the non-mitered corners of the radiating element 302 may extend beyond the static element 350. In alternative embodiments, the relative size, shape, position, and/or extent of overlap (e.g., partial overlap, complete overlap) between the radiating element 302 and static element 350 can vary depending upon antenna performance requirements.

In an embodiment, second substrate 352 has a thickness 354 (denoted as T2 in FIG. 3B) that is smaller than a thickness 334 (denoted as T1 in FIG. 3B) of first substrate 306. Accordingly, the second substrate 352 may be referred to as a "thin" substrate and the first substrate 306 a "thick" substrate.

Figure 3C:
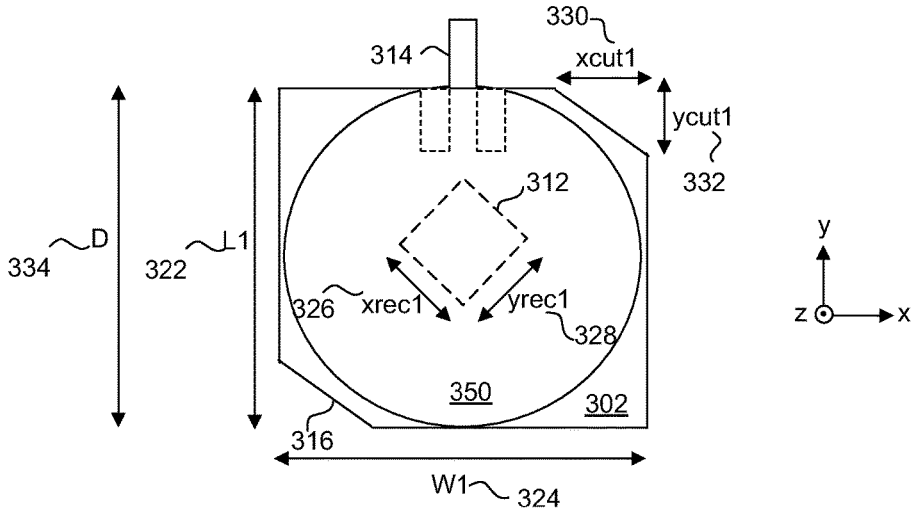

FIG. 3C denotes dimensions of interest that define the shape of antenna 300 according to an embodiment. An example shape of radiating element 302 is defined by: an antenna length 322 (denoted as L1), an antenna width 324 (denoted as W1), a width 326 of the aperture 312 (denoted as xrec1), a length 328 of the aperture 312 (denoted as yrec1), a width or first offset 330 of each corner of the first pair of opposing corners 316 (denoted as xcut1), and a length or second offset 332 of each corner of the first pair of opposing corners 318 (denoted as ycut1). An example of the static element 350 is a circular shape that is defined by a diameter 334 (denoted as D). Example values of dimensions 322-334 are provided in the table below.

| Dimensions | Values (in free space wavelength λ of the center frequency of the operating band) |
|---|---|
| L1—antenna length | 1.49λ |
| W1—antenna width | 1.11λ |
| xrec1—width of rectangular slot | 4.08λ |
| yrec1—length of rectangular slot | 4.46λ |
| xcut1—width of the cut | 3.4λ |
| ycut1—length of the cut | 1.59λ |
| D—static element diameter | 1.49λ |
| T1—first substrate thickness | Minimum λ/20 |
| T2—second substrate thickness | Minimum λ/40 |

The dimension values provided in the table are applicable for antenna operation, for example without limitation, at or around a free space wavelength λ of 4.84 mm. Free space wavelength λ may also be referred to as the wavelength λ in free space, center wavelength λ, or operating wavelength λ. A free space wavelength of 4.84 mm corresponds to a frequency of 62 GHz based on the relationship $f=c/\lambda$, where c is the speed of light. The 62 GHz frequency, also referred to as the center frequency or operating frequency, is within the 57 to 66 GHz frequency band, which is the IEEE 802.11ad protocol frequency band of operation.

In alternative embodiments, if the first substrate 306 and/or second substrate 352 is a different material and/or has different properties than those of a PCB-type material, the dimensional values can vary in the range of approximately +/−20% from those provided above.

Even if the shape of antenna 300 stays the same, the size of antenna 300 can be scaled up or down in accordance with the center frequency. Wavelength is inversely proportional to frequency. Hence, as frequency increases, wavelength decreases. Accordingly, as shown by the example dimensional values above, as frequency increases, antenna dimensions decrease. For example, if the center frequency doubles, antenna 300 would be halved in size. If the frequency doubled again, antenna 300 would be a quarter of the starting size.

Radiating element 302 can have any number of alternative shapes as discussed above for radiating element 202. In addition, static element 350 can also be a variety of shapes, sizes, and/or have relative "overlap" to radiating element 302. The particular combination of dimensions of the antenna 300 is optimized to achieve the desired performance characteristics. For example, static element 350 can be circular, elliptical, square, rectangular, symmetrical, non-symmetrical, or other shape. As another example, static element 350 can be smaller or larger than the radiating element 302. As still another example, static element 350 can include an aperture in the central region. As another example, static element 350 can comprise more than one segment (e.g., made up of four pieces located in the same layer instead of a single piece). As a further example, static element 350 can be offset from the radiating element 302 by varying amounts such that static element 350 is off-centered from the radiating element 302, static element 350 is substantially over the radiating element 302, static element 350 is substantially not over the radiating element 350, and the like. For example, the static element 350 may at least partially extend over the radiating element 302 and/or be substantially the same size as the radiating element 302.

Figure 3D:
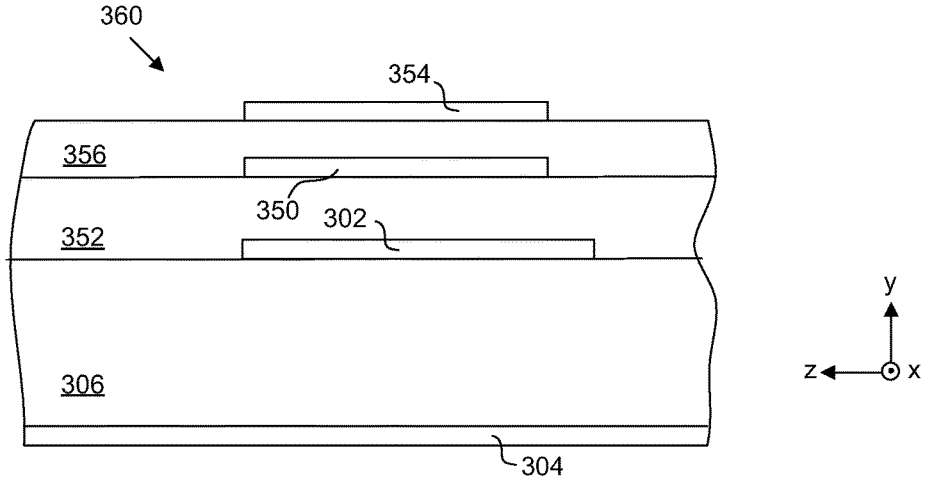
FIG. 3D illustrates an antenna including a static element according to an alternative embodiment.

In alternative embodiments, more than one static element may be included in an antenna. FIG. 3D shows a cross sectional view of an antenna 360 that includes at least two static elements: a static element 354 and the static element 350. A third substrate 356 is provided above the static element 350, and the static element 354 is provided above the third substrate 356. The second and third substrates 352, 356 may be similar to each other (e.g., third substrate is also a "thin" substrate). Each of the static elements 350, 354 may be similar or dissimilar from each other in shape, size, and/or position relative to each other and/or the radiating element 302.

Antennas 200 and 300 are fed (e.g., electrically connected to a RFIC) using a direct feed technique. Alternatively, antenna 200 and/or 300 can be fed via a coaxial feed, a capacitively coupled feed, a slot coupled feed, or other feed mechanism. Due to use of a "thick" substrate in antennas 200 and/or 300, the feed line or trace 214 and/or 314 may be wide (width in the x-axis direction), which in turn may increase the area of the feed network, make the antenna area larger, and the overall packaging area larger. In an embodiment, a technique to reduce the feed line width relative to antennas 200 and/or 300 is implemented in antennas 400 and 500. In antennas 400 and 500, described in detail below, at least the minimum distance between the radiating element and ground element—the minimum thickness of the substrate between the radiating element and ground element—is maintained in order to preserve the desired circular polarization bandwidth, while a via-based ground feed structure (also referred to as a modified ground feed structure or modified ground feed) is added between the radiating element and ground element layers to enable use of a thinner feed line without a reduction in antenna performance. The via-based ground feed structure maintains a unified ground plane potential for the antenna.

Accordingly, the footprint or area of antennas 200 and 300 may be larger than that of antennas 400 and 500 in the xy-plane at least due to the wider feed line of antennas 200 and 300 relative to antennas 400 and 500, respectively. However, the overall thickness or depth of antennas 400 and 500 may be greater than that of antennas 200 and 300, respectively, in the planes perpendicular to the xy-plane due to the inclusion of a via-based ground feed structure in antennas 400 and 500.

Figure 4A:
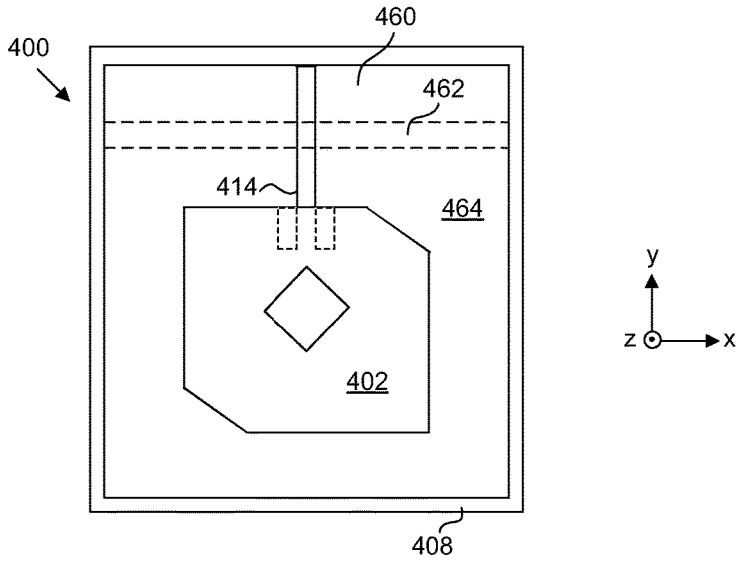
FIGS. 4A-4B illustrate an antenna including a modified ground feed structure according to still another embodiment.
Figure 4B:
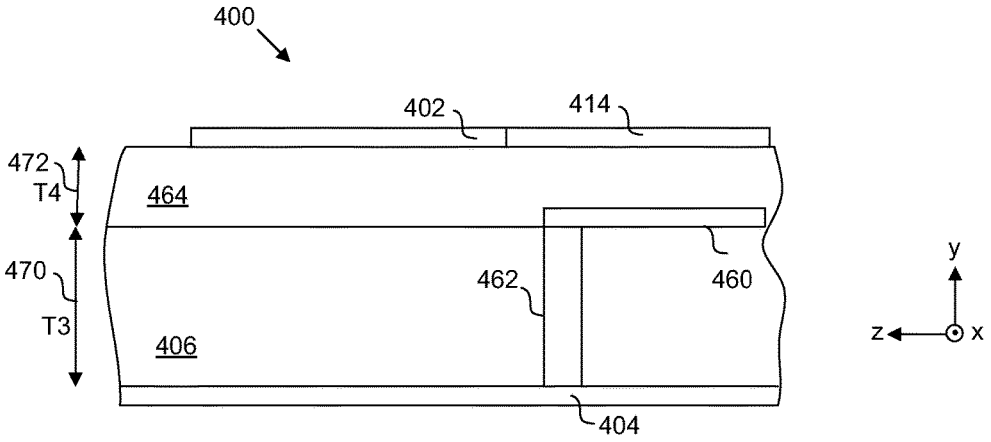

FIGS. 4A-4B illustrate a circular polarized in-package antenna 400 according to an alternate embodiment. FIG. 4A shows a top view of the antenna 400. FIG. 4B shows a cross sectional view of the antenna 400. Antenna 400, also referred to as a patch antenna, an antenna structure, a circular polarized antenna, or a patch antenna with a modified ground feed, comprises any of the antennas 104, 124, and/or 134 discussed above. Antenna 400 is similar to antenna 200 with the addition of a via-based ground feed structure.

Antenna 400 comprises a ground element 404 positioned below a first substrate 406, a modified ground feed element 460 positioned above the first substrate 406, a second substrate 464 positioned above the modified ground feed element 460, a radiating element 402 positioned above the second substrate 464, and a conductive via element 462 extending through the first substrate 406 to electrically connect the ground element 404 and modified ground feed element 460 with each other. In an embodiment, the modified ground feed element 460 (also referred to as a supplemental ground feed element), the conductive via element 462, and second substrate 464 comprise the via-based ground feed structure for antenna 400. Elements of antenna 400 may be packaged together in a package 408.

Radiating element 402 and ground element 404 are similar or identical to radiating element 202 and ground element 204, respectively, of antenna 200 discussed above. Likewise, the features of radiating element 402 are similar or identical to respective features of radiating element 202. In an embodiment, second substrate 464 has a thickness 472 (denoted as T4 in FIG. 4B) that is smaller than a thickness 470 (denoted as T3 in FIG. 4B) of first substrate 406. Accordingly, the second substrate 464 may be referred to as a "thin" substrate and the first substrate 406 a "thick" substrate. As an example, thickness 470 of first substrate 406 can be 0.3 mm and thickness 472 of second substrate 464 can be 0.06 mm. Conductive via element 462 is oriented perpendicular (or substantially perpendicular) to the planes or layers of ground element 406 and modified ground feed element 460. In an embodiment, the modified ground feed element 460 extends at least partially under at least a portion of a feed line or trace 414 and/or is not located or extend under (or is not co-linear in the y-axis direction with) the radiating element 402.

In an embodiment, the width of the feed line or trace 414 (width along the x-axis direction) is reduced by a factor of 2 to 5 relative to the width of feed line or trace 214 of antenna 200. The width of feed line or trace 414 can be approximately 0.02λ, where λ is the central or operating free space wavelength associated with antenna 400. And the width of feed line or trace 214 can be approximately 0.04λ to 0.1λ, where λ is the central or operating free space wavelength associated with antenna 200. For example, for an operating free space wavelength λ of 4.84 mm, the width of the feed line or trace 414 may be 0.1 mm while the width of the feed line or trace 212 may be 0.19 mm to 0.48 mm.

Each of the radiating element 402, ground element 404, modified ground feed element 460, conductive via element 462, and feed line or trace 414 comprises a conductive material such as, but not limited to, a metal, copper, gold, aluminum, and like equivalents. Each of the first and second substrates 406, 464 comprises a non-conductive material such as, but not limited to, plastic, fiberglass epoxy resin, TEFLON™, low temperature co-fired ceramic (LTCC), conventional PCB material, or the like. For example, in embodiments where the antenna 400 is embedded in or on a PCB, first substrate 406 and/or second substrate 464 may be a layer or part of the PCB. In some embodiments, each of the first substrate 406 and/or second substrate 464 may comprise one or more layers.

Antenna 300 may be fabricated using deposition and/or etching techniques. The shape of each of the radiating element 302 and modified ground feed element 460, for example, can be defined by a mask, and conductive material can be selectively deposited or etched in accordance with the mask to form the radiating element 302 layer and modified ground feed element 460 layer.

Figure 5A:
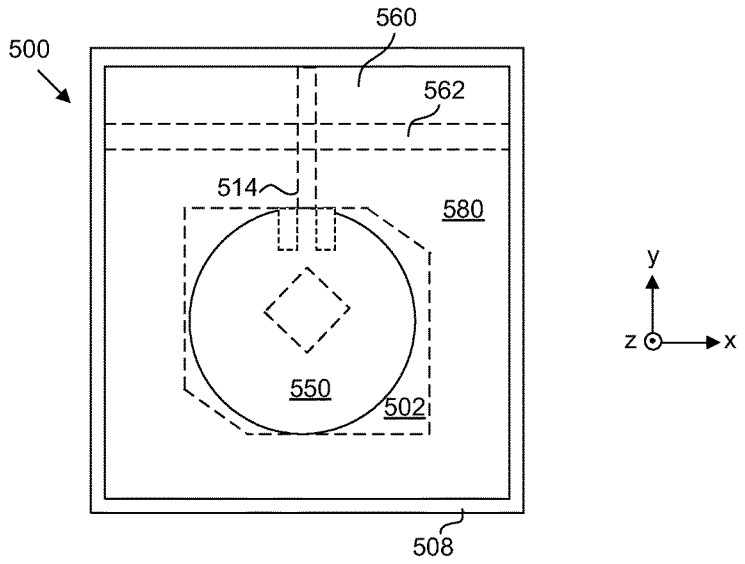
FIGS. 5A-5B illustrate an antenna including a static element and a modified ground feed structure according to an alternative embodiment.
Figure 5B:
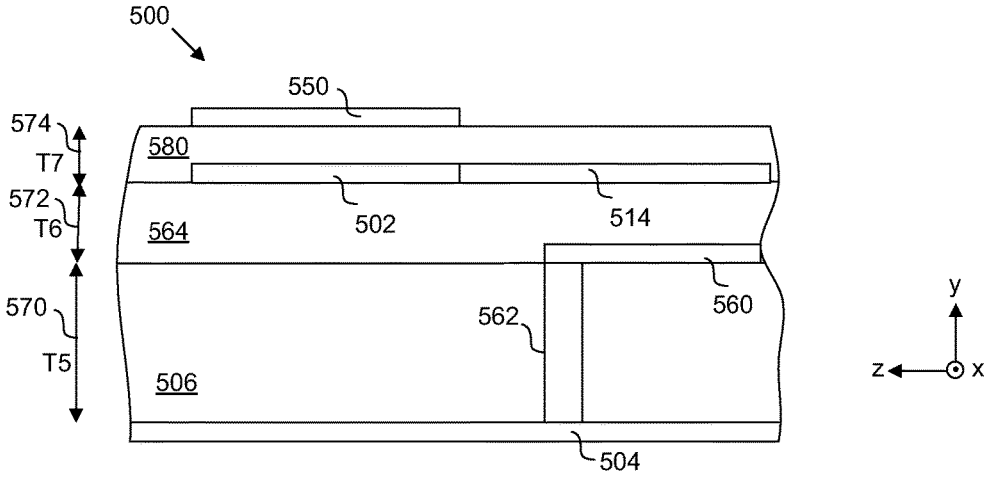

FIGS. 5A-5B illustrate a circular polarized in-package antenna 500 according to an another alternate embodiment. FIG. 5A shows a top view of the antenna 500. FIG. 5B shows a cross sectional view of the antenna 500. Antenna 500, also referred to as a patch antenna, an antenna structure, a circular polarized antenna, or a patch antenna with a modified ground feed and static element, comprises any of the antennas 104, 124, and/or 134 discussed above. Antenna 500 is similar to antenna 300 with the addition of a via-based ground feed structure.

Antenna 500 comprises a ground element 504 positioned below a first substrate 506, a modified ground feed element 560 positioned above the first substrate 506, a second substrate 564 positioned above the modified ground feed element 560, a radiating element 502 positioned above the second substrate 564, a third substrate 580 positioned over the radiating element 502, a static element 550 positioned over the third substrate 580, and a conductive via element 562 extending through the first substrate 506 to electrically connect the ground element 504 and modified ground feed element 560 with each other. In an embodiment, the modified ground feed element 560 (also referred to as a supplemental ground feed element), the conductive via element 562, and second substrate 564 comprise the via-based ground feed structure for antenna 500. Elements of antenna 500 may be packaged together in a package 508.

Radiating element 502, ground element 404, and static element 550 are similar or identical to radiating element 302, ground element 304, and static element 350, respectively, of antenna 300 discussed above. Likewise, the features of radiating element 502 and static element 550 are similar or identical to respective features of radiating element 302 and static element 350. The first substrate 506 has a thickness 570 (denoted as T5 in FIG. 5B), second substrate 564 has a thickness 572 (denoted as T6 in FIG. 5B), and third substrate 580 has a thickness 574 (denoted as T7 in FIG. 5B). In an embodiment, thickness 572 and/or thickness 574 is smaller than thickness 570. Thickness 572 can be the same or different than thickness 574. Each of the second and third substrates 506, 564 may be referred to as a "thin" substrate and the first substrate 506 a "thick" substrate. As an example, thickness 570 of first substrate 506 can be 0.3 mm, thickness 572 of second substrate 564 can be 0.15 mm, and thickness 574 of third substrate 580 can be 0.08 mm.

Conductive via element 562 is oriented perpendicular (or substantially perpendicular) to the planes or layers of ground element 506 and modified ground feed element 560. In an embodiment, the modified ground feed element 560 extends under at least a portion of a feed line or trace 514 but is not located under (or is not co-linear in the y-axis direction with) the radiating element 502.

In an embodiment, the width of the feed line or trace 514 (width along the x-axis direction) is reduced by a factor of 2 to 5 relative to the width of feed line or trace 314 of antenna 300. The width of feed line or trace 514 can be approximately 0.02λ, where λ is the central or operating free space wavelength associated with antenna 500. And the width of feed line or trace 314 can be approximately 0.04λ to 0.1λ, where λ is the central or operating free space wavelength associated with antenna 300. For example, for an operating free space wavelength λ of 4.84 mm, the width of the feed line or trace 514 may be 0.1 mm while the width of the feed line or trace 312 may be 0.19 mm to 0.48 mm.

Each of the radiating element 502, ground element 504, static element 550, modified ground feed element 560, conductive via element 562, and feed line or trace 514 comprises a conductive material such as, but not limited to, a metal, copper, gold, aluminum, and like equivalents. Each of the first, second, and third substrates 506, 564, 580 comprises a non-conductive material such as, but not limited to, plastic, fiberglass epoxy resin, TEFLON™, low temperature co-fired ceramic (LTCC), conventional PCB material, or the like. For example, in embodiments where the antenna 500 is embedded in or on a PCB, first substrate 506, second substrate 564, and/or third substrate 580 may be a layer or part of the PCB. In some embodiments, each of the first substrate 506, second substrate 564, and/or third substrate 580 may comprise one or more layers.

Antenna 500 may be fabricated using deposition and/or etching techniques. The shape of each of the radiating element 502 and static element 550, for example, can be defined by a mask, and conductive material can be selectively deposited or etched in accordance with the mask to form the radiating element 502 layer and static element 550 layer.

Antennas 200, 300, 400, and 500 are depicted herein as having a radiating element in a layer above a ground of the radiating element. In this orientation, the direction of circular polarization emission is considered to be in a direction perpendicular to the radiating element layer and away from the ground of the radiating element. However, in alternative embodiments, the radiating element can be in a layer below the ground of the radiating element by flipping the antenna structures described above. Such flipped antenna structure may be mounted on a bottom side of a PCB or package, for example, as shown by antennas 124 in FIG. 1C. More than one antenna may also be stacked on top of each other (separated by an appropriate non-conductive material) as shown by antennas 134 in FIG. 1D.

III. Antenna Performance

Figure 6:
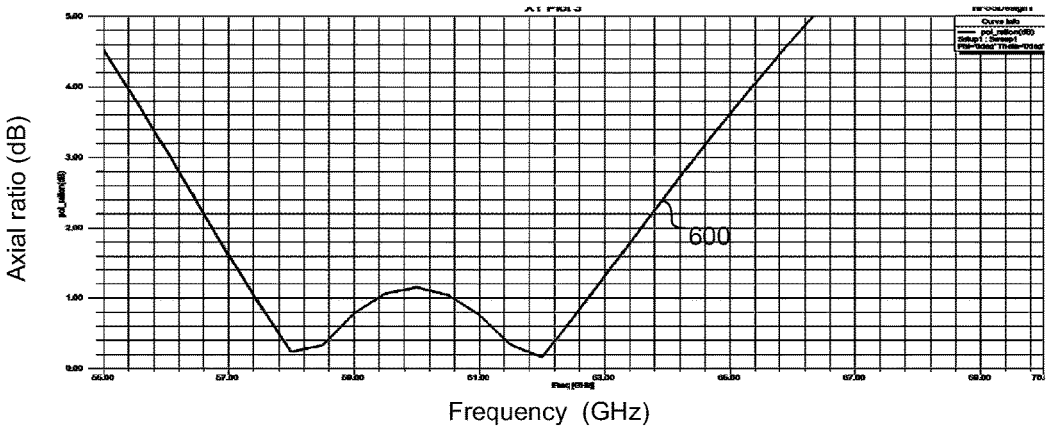
FIGS. 6-7 illustrate performance plots of embodiments of an antenna.

FIG. 6 shows an example plot 600 corresponding to performance of antenna 200 according to an embodiment. The horizontal axis represents frequency in GHz and the vertical axis represents axial ratio in dB. Axial ratio, also referred to as polarization ratio, measures the performance between two perpendicular linear polarizations. If the antenna emission has one of the linear polarizations that is significantly larger than the other linear polarization, the ratio of the two linear polarizations would be higher. In an embodiment, an axial ratio value of approximately 3 dB or less is considered to be circularly polarized emission. Above approximately 3 dB is considered not to be circular polarization and is undesirable performance. Alternatively, acceptable axial ratio values may be approximately at 2 dB or less.

Plot 600 shows antenna 200 handling circularly polarized emission in the frequency range of approximately 56-64 GHz. The two "dips" of plot 600 are attributed to the presence of aperture 212 in antenna 200. The aperture 212 may be used to provide impedance matching for antenna 200 (e.g., 50 ohms). In some embodiments, additional impedance matching slots/apertures may be used to improve the return loss of the antenna.

Figure 7:
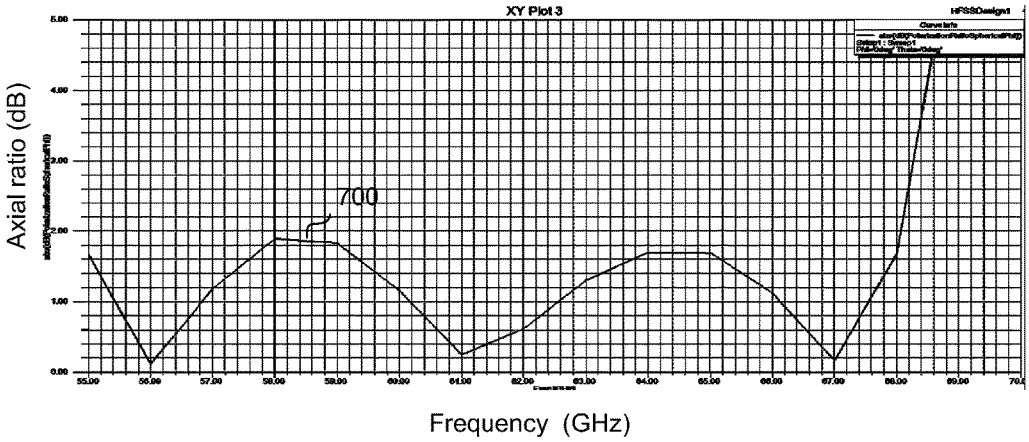

FIG. 7 shows an example plot 700 corresponding to performance of antenna 300 according to an embodiment. Plot 700 shows antenna 300 handling circularly polarized emission in the frequency range of approximately 55-68 GHz. The three "dips" of plot 700 are attributed to the presence of static element 350 (in addition to aperture 312) in antenna 300. The bandwidth of circular polarization operation in plot 700 is larger or wider than that of plot 600 due to the combined effect of the static element 350 and radiating element 302.

The circular polarization bandwidth of antenna 500 is similarly wider or larger than the circular polarization bandwidth of antenna 400 due to the presence of both a static element and radiating element in antenna 500.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. An apparatus comprising:

at least one multi-layer antenna structure including a ground element, a radiating element, a static element, a single feed line connected to the radiating element, a first substrate, and a second substrate, the radiating element having a non-symmetrical outer perimeter shape, the radiating element located between the ground element and the static element, the first substrate located between the radiating element and the ground element, and the second substrate is located between the radiating element and the static element such that the radiating element at least partially overlaps with the ground element and the static element;

wherein the antenna structure emits circularly polarized radiation, wherein a thickness of the first substrate is at least approximately two times larger than a thickness of the second substrate, and wherein the apparatus is configured to operate in the 60 GHz range.

2. The apparatus of claim 1, wherein the non-symmetrical outer perimeter shape of the radiating element includes a pair of opposing corners having a truncated shape, a pair of opposing corners having a mitered edge, or a pair opposing corners having a rounded shape.

3. The apparatus of claim 1, wherein the radiating element includes an aperture.

4. The apparatus of claim 3, wherein the aperture is located at a central region of the radiating element or substantially at a center of the radiating element.

5. The apparatus of claim 3, wherein the aperture comprises a geometric shape, a symmetric shape, a non-symmetric shape, a square shape, a rectangular shape, a circular shape, or an elliptical shape.

6. The apparatus of claim 1, wherein the static element comprises a non-radiating structure.

7. The apparatus of claim 1, wherein each of the radiating element, the static element, and the ground element comprises an electrically conductive material, and each of the first substrate and the second substrate comprises a non-electrically conductive material.

8. The apparatus of claim 1, wherein the first substrate has a minimum thickness of approximately $\lambda/20$ and the second substrate has a minimum thickness of approximately $\lambda/40$, where $\lambda$ comprises an operating wavelength of the circularly polarized radiation.

9. The apparatus of claim 1, wherein the antenna structure is configured to operate in a millimeter wave (mm-wave) or sub-millimeter wave (sub-mm wave) frequency band.

10. The apparatus of claim 1, wherein the single feed line connects the antenna structure to an integrated circuit, wherein the antenna structure further includes a supplemental ground feed structure electrically coupled to the ground element, wherein the supplemental ground feed structure is located between the single feed line and the ground element.

11. The apparatus of claim 1, wherein the antenna structure further includes a second static element located adjacent to a side of the static element that is distal to the radiating element.

12. The apparatus of claim 1, further comprising:

a second antenna structure including a second radiating element, a second static element, and a second single feed line connected to the second radiating element, the second radiating element having a second non-symmetrical outer perimeter shape;

an integrated circuit connected to the single feed line to drive the antenna structure and connected to the second single feed line to drive the second antenna structure.

13. An apparatus comprising:

a patch antenna including:

means for emitting a circularly polarized electromagnetic radiation, the means for emitting (1) having a non-symmetrical outer perimeter shape and (2) including an aperture located at a central region of the means for emitting to provide impedance matching at a particular frequency band;

means for increasing bandwidth of the circularly polarized electromagnetic radiation;

means for grounding; and means for feeding the means for emitting, the means for feeding connected to the means for emitting;

wherein the means for feeding is electrically coupled between the means for emitting and a circuit that drives the patch antenna, and wherein the means for emitting is located between the means for grounding and the means for increasing bandwidth such that the means for emitting at least partially overlaps with the means for grounding and the means for increasing bandwidth.

14. The apparatus of claim 13, wherein the non-symmetrical outer perimeter shape of the means for emitting includes a pair of opposing corners having a truncated shape, a pair of opposing corners having a mitered edge, or a pair opposing corners having a rounded shape.

15. The apparatus of claim 13, wherein the aperture comprises a geometric shape, a symmetric shape, a non-symmetric shape, a square shape, a rectangular shape, a circular shape, or an elliptical shape.

16. The apparatus of claim 13, wherein the means for feeding comprises a single feed line.

17. The apparatus of claim 13, wherein each of the means for emitting, the means for increasing bandwidth, and the means for grounding comprises an electrically conductive material.

18. The apparatus of claim 13, wherein the patch antenna further includes means for reducing a width of the means for feeding, and wherein the means for reducing the width is electrically coupled to the means for grounding and the means for reducing the width is located between the means for feeding and the means for grounding.

19. The apparatus of claim 13, wherein the means for increasing bandwidth at least partially extends over the means for emitting or is substantially a same size as the means for emitting.

20. An antenna comprising:

a radiating element having (1) a non-symmetrical outer perimeter shape and one or more mitered corners, and (2) an aperture located at a central region of the radiating element to provide impedance matching at a particular frequency band;

a ground element;

a parasitic element; and a single feed line connecting the radiating element to an integrated circuit;

wherein the radiating element is located between the ground element and the parasitic element such that the parasitic element overlaps the central region and at least one mitered corner, from the one or more mitered corners, of the radiating element, and one or more other portions of the radiating element extend beyond the parasitic element.

21. The antenna of claim 20, wherein the non-symmetrical outer perimeter shape of the radiating element includes a pair of opposing corners having a truncated shape, a pair of opposing corners having a mitered edge, or a pair opposing corners having a rounded shape.

22. The antenna of claim 20, further comprising a supplemental ground feed structure electrically coupled to the ground element, wherein the supplemental ground feed structure is located between the single feed line and the ground element.

23. The antenna of claim 20, wherein the parasitic element comprises a geometric shape, a circular shape, a symmetric shape, an approximately circular shape, a shape different from the radiating element, approximately a same size as the radiating element, or is located at least partially co-linear with the radiating element.

24. The antenna of claim 22, wherein the supplemental ground feed structure includes a supplemental ground feed element and a conductive via element, the supplemental ground feed element located between the single feed line and the ground element, and the conductive via element located between the supplemental ground feed element and the ground element.

25. The antenna of claim 20, wherein the single feed line has a width of approximately 0.02λ, where λ is an operating wavelength of the antenna.

* * * * *